US006745499B2

(12) United States Patent
Christensen et al.

(10) Patent No.: US 6,745,499 B2
(45) Date of Patent: Jun. 8, 2004

(54) SHOE SOLE HAVING A RESILIENT INSERT

(75) Inventors: Brian Christensen, Centerville, MA (US); Todd Ellis, Boston, MA (US); Paul E. Litchfield, Westboro, MA (US)

(73) Assignee: Reebok International Ltd., Canton, MA (US)

( * ) Notice: Subject to any disclaimer, the term of this patent is extended or adjusted under 35 U.S.C. 154(b) by 0 days.

(21) Appl. No.: 10/153,880

(22) Filed: May 24, 2002

(65) Prior Publication Data

US 2003/0217484 A1 Nov. 27, 2003

(51) Int. Cl.[7] ..... A43B 13/20
(52) U.S. Cl. ..... 36/29
(58) Field of Search ..... 36/29, 153, 28

(56) References Cited

U.S. PATENT DOCUMENTS

| | | | | |
|---|---|---|---|---|
| 1,069,001 | A | | 7/1913 | Guy |
| 1,193,608 | A | | 8/1916 | Poulson |
| 1,605,985 | A | | 11/1926 | Rasmussen |
| 2,215,463 | A | | 9/1940 | Mauro |
| 2,266,476 | A | | 12/1941 | Reiss |
| 2,605,560 | A | * | 8/1952 | Gouabault ..... 36/29 |
| 2,863,230 | A | * | 12/1958 | Cortina ..... 36/29 |
| 3,120,712 | A | | 2/1964 | Menken |
| 3,225,463 | A | | 12/1965 | Burnham |
| 3,341,952 | A | | 9/1967 | Dassler |
| 3,469,576 | A | | 9/1969 | Smith et al. |
| 4,100,686 | A | | 7/1978 | Sgarlato et al. |
| 4,183,156 | A | | 1/1980 | Rudy |
| 4,219,945 | A | * | 9/1980 | Rudy ..... 36/29 |
| 4,358,902 | A | | 11/1982 | Cole et al. |
| 4,446,634 | A | | 5/1984 | Johnson et al. |
| 4,458,430 | A | | 7/1984 | Peterson |
| 4,547,978 | A | | 10/1985 | Radford |
| 4,577,417 | A | | 3/1986 | Cole |

(List continued on next page.)

FOREIGN PATENT DOCUMENTS

| | | | |
|---|---|---|---|
| DE | 820869 | | 12/1951 |
| DE | 28 00 359 A1 | | 7/1979 |
| EP | 0 095 357 B1 | | 11/1983 |
| EP | 0 301 331 A2 | | 2/1989 |
| EP | 0 714 613 A3 | | 6/1996 |
| FR | 720257 | | 2/1932 |
| FR | 2 452 889 | | 10/1980 |
| FR | 2 614 510 A1 | | 11/1988 |
| FR | 2 663 208 A1 | | 12/1991 |
| GB | 338266 | | 12/1930 |
| GB | 2 039 717 A | | 8/1980 |
| GB | 2 085 278 A | | 4/1982 |
| GB | 2 114 425 A | | 8/1983 |
| GB | 2 201 082 A | | 8/1988 |
| JP | 6-181802 | | 7/1994 |
| WO | WO 91/16831 | | 11/1991 |
| WO | 93/12683 | * | 7/1993 |
| WO | WO 93/12685 | | 7/1993 |
| WO | WO 93/14659 | | 8/1993 |
| WO | 95/20332 | * | 8/1995 |
| WO | WO 95/20332 | | 8/1995 |

*Primary Examiner*—Ted Kavanaugh
(74) *Attorney, Agent, or Firm*—Sterne Kessler Goldstein & Fox, P.L.L.C.

(57) ABSTRACT

The present invention relates to a shoe sole having a resilient insert which provides fluidic cushioning and support to the foot of the wearer. The resilient insert has a heel chamber, a forefoot chamber and a passageway, which fluidly connects the heel chamber to the forefoot chamber. As the wearer walks or run and applies impact forces to the shoe sole, fluid within the resilient insert flows back and forth between the heel chamber and the forefoot chamber to provide continuous cushioning and support to the heel and fore portion of the wearer's foot. The resilient insert and components of the sole are specifically constructed and assembled to avoid friction and turbulence therein, which can result in the production of audible and undesirable noises within the interior of the shoe sole.

17 Claims, 13 Drawing Sheets

U.S. PATENT DOCUMENTS 4,763,426 A 8/1988 Polus et al.
4,779,359 A 10/1988 Famolare, Jr.
4,799,319 A 1/1989 Zellweger
4,817,304 A 4/1989 Parker et al.
4,845,861 A 7/1989 Moumdjian
4,856,208 A 8/1989 Zaccaro
4,887,367 A * 12/1989 Mackness et al. ..... 36/28
4,905,383 A 3/1990 Beckett et al.
4,936,030 A 6/1990 Rennex
4,999,931 A 3/1991 Vermeulen
5,005,575 A 4/1991 Geri
5,025,575 A 6/1991 Lakic
5,131,174 A 7/1992 Drew et al.
RE34,102 E 10/1992 Cole et al.
5,179,792 A 1/1993 Brantingham
5,195,257 A 3/1993 Holcomb et al.
5,230,249 A 7/1993 Sasaki et al.
5,253,435 A 10/1993 Auger et al.
5,255,451 A 10/1993 Tong et al.
5,295,314 A 3/1994 Moumdjian
5,311,674 A 5/1994 Santiyanont et al.
5,313,717 A 5/1994 Allen et al.
5,335,382 A 8/1994 Huang
5,343,639 A 9/1994 Kilgore et al.
5,353,459 A 10/1994 Potter et al.
5,353,525 A 10/1994 Grim
5,375,346 A 12/1994 Cole et al.
5,406,719 A 4/1995 Potter
5,416,986 A 5/1995 Cole et al.
5,545,463 A 8/1996 Schmidt et al.
5,572,804 A 11/1996 Skaja et al.
5,625,964 A 5/1997 Lyden et al.
5,625,965 A 5/1997 Blissett et al.
5,664,341 A 9/1997 Schmidt et al.
5,701,687 A * 12/1997 Schmidt et al. ..... 36/29
5,771,606 A 6/1998 Litchfield et al.
5,832,630 A 11/1998 Potter
5,839,209 A * 11/1998 Healy et al. ..... 36/30 A

* cited by examiner

SHOE SOLE HAVING A RESILIENT INSERT

BACKGROUND OF THE INVENTION

1. Field of the Invention

The present invention relates generally to footwear, and more particularly to a shoe sole having a resilient insert to provide cushioning and support to the foot, wherein the insert is constructed to reduce or eliminate the production of undesirable noises within the components of the shoe sole as a force is applied thereto.

2. Background Art

Over the last century, shoe manufacturers have sought to develop a shoe which strikes a balance between cushioning and support. Throughout the course of an average day, the feet and legs are subjected to substantial impact forces. Running, jumping, walking and even standing exert forces upon the feet, legs and joints which can lead to discomfort, fatigue and injury.

Remarkably, the anatomy of the human foot is capable of withstanding and dissipating substantial impact forces. The natural fat pads of the heel and forefoot, as well as the spring-like flexibility of the longitudinal and transverse arches, help to cushion and absorb impact forces applied to the foot. Equally important, the structure of the foot transfers the absorbed forces to the legs and associated muscles as energy, to facilitate locomotion. For example, when walking or running, the Achilles tendon and arches of the foot stretch and contract to transfer and store energy (i.e., the absorbed impact forces) in the tendons and ligaments of the foot and leg. As the contractions are released, the energy stored in the tendons and ligaments is also released to power the stride or gait and to reduce the "work" assumed by the muscles of the leg.

While the anatomy of the foot possesses natural cushioning and energy-absorbing and energy-transferring characteristics, the foot and leg alone cannot effectively handle many of the forces applied to the foot while engaging in athletic activity. Accordingly, to avoid fatigue and injuries (such as damage to the muscles, tendons and ligaments and stress fractures to the bones), footwear which provides proper support and cushioning to the foot and leg should be worn.

Ideally, footwear should complement and work with the bio-mechanics of the foot by having a component which absorbs shock, but also possesses resiliency sufficient to avoid collapsing under the weight of the wearer (e.g., a shoe sole having an insole, midsole and outsole). Many attempts have been made to improve the cushioning, support and resiliency of a shoe sole. An article of footwear having a cushioning member disposed therein is described in International Patent Publication No. PCT/US94/00895 to Reebok International Ltd., the disclosure of which is incorporated herein in its entirety by reference. The article of footwear comprises a sole and a resilient cushioning member containing air at ambient pressure positioned within a cavity of the sole. The resilient cushioning member is blow-molded from an elastomeric material. It includes a heel chamber, a forefoot chamber, and a communication chamber which allows air to flow between the heel and forefoot chambers. The communication chamber contains impedance means (i.e., a pinched or circuitous pathway disposed within the communication chamber) to regulate the flow of air between the heel and forefoot chambers. As a force is applied to either the heel or forefoot of the sole, air within the resilient insert is transferred from one chamber to the other through the communication chamber of the insert. The impedance means disposed within the communication chamber controls the rate at which air flows between the chambers to prevent "bottoming out", which would leave either chamber without sufficient air to cushion or support the heel or forefoot of the wearer.

Another shoe which incorporates a system for providing resilient support and cushioning to the foot of the wearer while standing, walking or running is described in U.S. Pat. No. 5,771,606 to Litchfield et al., the disclosure of which is also incorporated herein in its entirety by reference. U.S. Pat. No. 5,771,606 discloses a resilient insert for a shoe sole having a plurality of heel chambers, a plurality of forefoot chambers, and a centrally located passage which fluidly connects the heel and forefoot chambers of the resilient insert. The resilient insert is blow-molded from an elastomeric material and contains air at ambient pressure. It is positioned between and bonded to a midsole and an outsole. As the heel of the shoe strikes a surface, air within the resilient insert is transferred from the plurality of heel chambers to the plurality of forefoot chambers, via the centrally located passage, to provide continuous cushioning and support to the wearer.

Like the article of footwear described in the International Patent Publication No. PCT/US94/00895 above, the centrally located passage of U.S. Pat. No. 5,771,606 may contain impedance means to restrict the flow of air between the chambers to keep air from rushing out of the heel and chambers of the resilient insert. As a result, air is transferred between the chambers of the resilient insert in a controlled or regulated manner to provide sufficient support and cushioning to both the heel and forefoot portion of the shoe, as the wearer proceeds through heel strike to toe-off.

Without question, the resilient inserts discussed above provide an unparalleled balance of cushioning and support to the foot of the wearer. However, experience has shown that the disclosed inserts may produce undesirable squeaks, wheezes and breathing sounds when a force is applied thereto. The state of the molding art at the time of these inventions was such that the disclosed resilient inserts are formed using a blow-molding technique resulting in "flashings" or excess edges of elastomeric material which are used as laminating areas to secure or bond the resilient inserts within the cavities of the midsoles, and to assist in the formation of segmenting channels within the interior of the heel and forefoot chambers. As a force is applied to and relieved of the shoe sole, the resilient insert recovers at a rate different than the foam which forms the midsole of the shoe. As a result, the resilient insert and midsole exert stresses on each other, which cause the components to slightly pull apart at the bonding areas. Over time, the application of impact forces to the shoe sole results in the production of friction between the resilient insert and the midsole of the shoe. This friction within the components of the shoe sole can generate an audible noise (a "squeak") as the user moves, which is not desirable.

In addition, where the angles of the disclosed resilient insert are somewhat "flat", the resilient insert is not necessarily permitted to sit flush against, and securely bond to, the walls of the midsole cavity or the outsole of the shoe sole. It is in these areas of potentially discontinuous bonding where further stress and friction are produced, resulting in the audible squeak mentioned above, as the wearer passes from stride to stride.

The blow-molding technique mentioned above has a further disadvantage in that the communication chamber or fluid passageway extending between the heel and forefoot chambers of the insert cannot be formed particularly small in diameter. As a result, a pinched or circuitous impedance structure is required to regulate the flow of air from one chamber to the other, similar to a conventional valve mechanism. The pinched or circuitous channel can, however, create excessive turbulence in the communication chamber or passageway. In some instances, this turbulence is audible to the wearer as a "wheezing" or "breathing" sound.

Attempts have been made to reduce the undesirable squeaking, wheezing and breathing sounds discussed above. One such attempt involves wrapping fabric tape about the perimeter of the insert. However, while some fabric tape wrappings have successfully prevented friction and squeaking about the sides of the cushioning insert, they have not been successful in preventing friction and squeaking at other areas of the cushioning insert. Furthermore, such wrappings have no affect on reducing the wheezing or breathing sound which emanates from within the communication chamber or passage between the heel and forefoot chambers.

Accordingly, it is an object of the present invention to provide an article of footwear with a sole and resilient insert which offers cushioning and support to the structures of the foot as the user moves through the gait cycle from heel strike to toe-off.

It is a further object of the invention to provide an article of footwear with a midsole, a resilient insert, and an outsole shaped and constructed of materials which work together to absorb and transfer impact forces away from the anatomy of the foot without producing undesirable noises.

It is still another object of the invention to provide a resilient insert for a shoe with a heel chamber, a forefoot chamber, and a centrally located passageway to communicate air between the heel and forefoot chambers to support and cushion the foot, without generating an audible turbulence sound within the interior of the passageway.

BRIEF SUMMARY OF THE INVENTION

The present invention solves the above stated problems by providing a shoe sole with a midsole, an outsole, and a resilient insert. The midsole is formed from a first elastomeric material and comprises a top surface, a bottom surface, and a side wall which define a first thickness. The outsole has a top surface, a bottom surface, and a side wall which define a second thickness. The resilient insert is formed from a second elastomeric material and is disposed between the bottom surface of the midsole and the top surface of the outsole. The resilient insert comprises a heel chamber, a forefoot chamber, and a passageway fluidly connecting the heel chamber and the forefoot chamber. The second elastomeric material of the resilient insert enables the resilient insert to recover at a rate similar to the rate of recovery of the midsole, to permit the resilient insert and midsole to absorb and recover from impact forces applied to the shoe sole at substantially equal rates.

In another embodiment of the invention, a shoe sole has a midsole, an outsole, and a resilient insert. The midsole is formed from a first elastomeric material and comprises a top surface, a bottom surface, and a side wall which define a first thickness. The outsole has a top surface, a bottom surface, and a side wall which define a second thickness. The resilient insert is formed from a second elastomeric material and is disposed between the bottom surface of the midsole and the top surface of the outsole. The second elastomeric material of the resilient insert enables the resilient insert to recover at a rate similar to the rate of recovery of the midsole, to permit the resilient insert and midsole to absorb and recover from impact forces applied to the shoe sole at substantially equal rates.

In yet another embodiment of the invention, a shoe sole comprises a resilient insert, an outsole and a midsole. The resilient insert has a top surface, a bottom surface, and a side wall which extends between the top surface and the bottom surface. The midsole has a top surface, a bottom surface, and a side wall which define a thickness, and a cavity defined within the bottom surface of the midsole having a top surface and a peripheral wall. The cavity of the midsole receives the resilient insert such that the side wall of the resilient insert is arranged substantially flush against the peripheral wall of the cavity to prevent the formation of gaps between the cavity and the resilient insert to reduce the production of friction and related noise.

In still another embodiment of the invention, a shoe sole comprises a midsole and an insert disposed within a cavity of the midsole. Upon application of a force to the top surface of the midsole, the midsole insert are compressed, and upon recovery from the force, shear stress between the resilient insert and the midsole is insufficient to cause relative movement between the midsole and the resilient insert.

In yet another embodiment of the invention, a method for constructing a shoe sole comprises the steps of molding a midsole from a first elastomer, forming a cavity in the midsole, molding a resilient insert from a second elastomer, inserting and bonding the resilient insert within the cavity of the midsole, and securing an outsole to the resilient insert and midsole. The elastomeric material of the resilient insert enables the resilient insert to recover at a rate similar to the rate of recovery of the midsole, to permit the resilient insert and midsole to absorb and recover from impact forces applied to the shoe sole at substantially equal rates.

In still another embodiment of the invention, a method for manufacturing a shoe sole comprises the steps of forming a foam midsole having a cavity with a depth, forming a resilient insert with a height greater than the depth of the cavity, placing the resilient insert in the cavity, and applying an adhesive to the bottom of the midsole and securing said outsole to the midsole and resilient insert placed in the cavity, wherein a bulge is formed in the top of the midsole by the force of the outsole against the resilient insert.

BRIEF DESCRIPTION OF THE DRAWINGS/ FIGURES

The foregoing and other features and advantages of the invention will be made apparent from the following detailed description of a preferred embodiment of the invention, and the accompanying drawings in which.

DETAILED DESCRIPTION OF THE INVENTION

Figure 1:
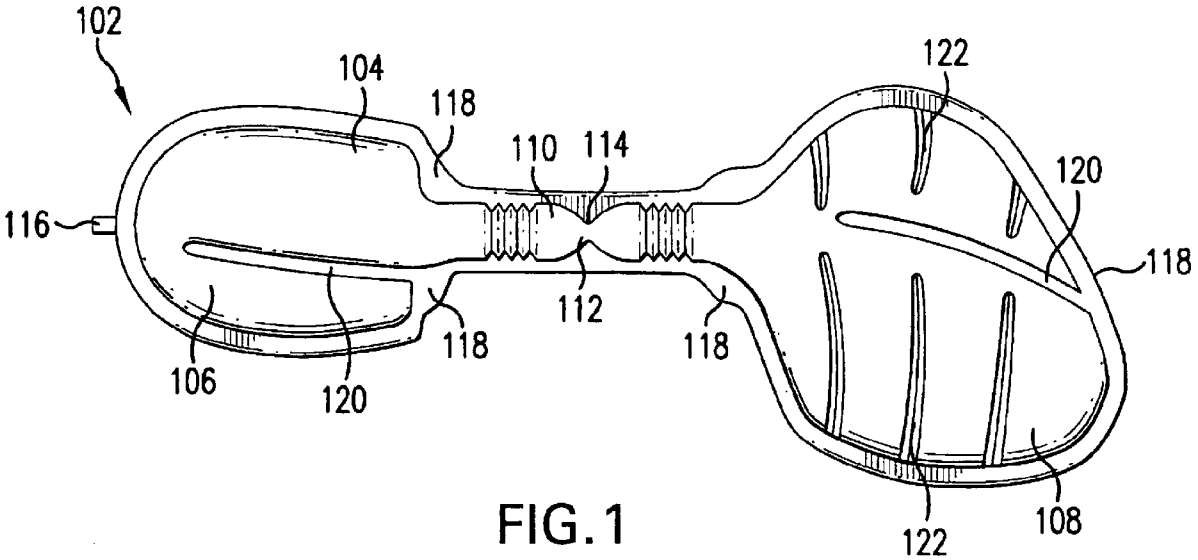
FIG. 1 (PRIOR ART)
FIG. 1 is a top plan view of a prior art resilient insert for an article of footwear.

A preferred embodiment of the present invention appears below with reference to the above-described figures, where like reference numerals refer to identical or functionally similar structures or components. Also, in the figures, the left most digit of each reference number corresponds to the figure in which the reference number is first used. While specific configurations have been discussed below, it should be understood by those skilled in the art that the discussion represents an illustration of a preferred embodiment, and that other configurations could be used, either in whole or part, without departing from the spirit and scope of the invention.

Figure 2:
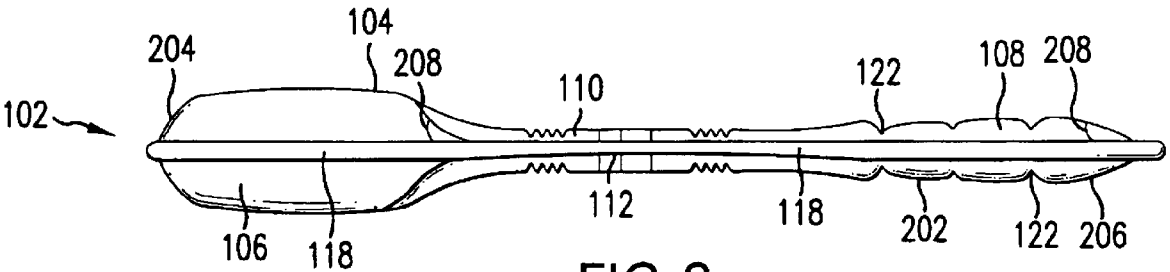
FIG. 2 (PRIOR ART)
FIG. 2 is a right side elevational view of the prior art resilient insert shown in FIG. 1.
Figure 3:
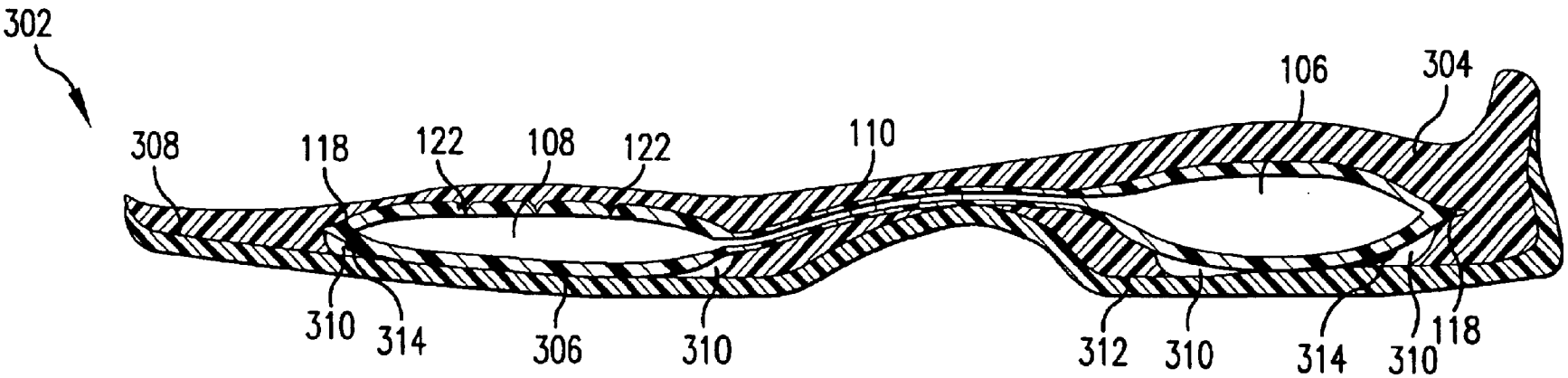
FIG.3 (PRIOR ART)
FIG. 3 is a cross-sectional view of a prior art resilient insert embedded within a cavity of a midsole and secured to an outsole.

Referring now to FIGS. 1–3, a resilient insert 102 of the prior art is shown. The resilient insert shown in FIGS. 1–3 is essentially the same as that disclosed in International Patent Publication No. PCT/US94/00895 mentioned in the Background of the Invention section above, and which is incorporated herein in its entirety by reference. Resilient insert 102 provides continuous cushioning to the wearer's foot, such that a wearer's stride forces air within the resilient insert to flow in a manner complementary with respect to the wearer's stride and the application of forces to the anatomical structure of the foot.

Resilient insert 102, as shown in FIGS. 1 and 2, comprises a top surface 104, a bottom surface 204, an upper side wall 202, and a lower side wall 206. Together, the top and bottom surfaces and the upper and lower side walls generally define a heel chamber 106, a forefoot chamber 108 and a passageway 110. It should be realized that the top and bottom, as well as the sides of resilient insert 102 are mirror images of one another and that, in light of its symmetrical nature, resilient insert 102 can be incorporated in either a left or right shoe by merely turning the resilient insert over to its reverse side. This feature is true of the resilient insert of the present invention, as well, and increases the ease, and reduces the expense, of manufacturing.

With continuing reference to FIGS. 1–3, passageway 110 fluidly connects heel chamber 106 and forefoot chamber 108 to permit air to flow between the chambers in response to forces applied to the bottom of the wearer's foot. As discussed above in the application, passageway 110 comprises impedance structure 112 which acts as a valve or regulator to control the flow of air as it passes from one chamber to the other. More particularly, impedance structure 112 prevents air from rushing out of either the heel chamber 106 or forefoot chamber 108, which would leave the chamber with insufficient air to cushion and support the corresponding structures of the foot (i.e., the chamber "bottoms out"). While impedance structure 112 is shown as being pinched at 114 to narrow the diameter of passageway 110, it should be understood that other impedance structures have been utilized in resilient insert 102, including those disclosed in the International Patent Publication No. PCT/US94/00895 to Reebok International Ltd. and U.S. Pat. No. 5,771,606.

Resilient insert 102 of the prior art is formed of a suitably resilient material so that it can compress with the application of force and expand with the delivery of air, while also resisting breakdown. As discussed above, resilient insert 102 is extrusion blow-molded, using a known technique, from an elastomeric material, particularly, PELLETHANE 2355 95 AE, available from Dow Chemical Company. To form the resilient insert of the prior art shown in FIGS. 1–3, the elastomer is extruded into a mold and air at ambient pressure is blown into the mold and elastomer through a blow-molding pin 116 (FIG. 1) to define the structure and features of the resilient insert. As resilient insert 102 takes shape within the mold, a flashing 118 (i.e., an excess of the elastomeric material) forms about the peripheral edge of the resilient insert.

Chamber partitions 120 and flex grooves 122 are also formed in resilient insert 102 during the blow-molding process. Partitions 120 help to direct the flow of air into areas of the chambers, which have been designed to correspond to particular features of the foot. Flex grooves 122 enable forefoot chamber 108 of resilient insert 102 to flex under the phalanges and metatarsal heads of the wearer's foot as the foot rolls through heel-strike to toe-off. Upon filling the resilient insert to capacity with air at ambient pressure, blow-molding pin 116 is removed and resilient insert 102 is sealed. When the elastomer has cured, resilient insert 102 is removed from the mold and appears substantially identical to that shown in FIGS. 1 and 2.

FIG. 3 shows the resilient insert of FIGS. 1 and 2 disposed within a sole construction 302 having a midsole 304 and an outsole 306. Midsole 304 is injection molded from a foam to provide a "cradle" for the resilient insert and to provide additional cushioning to the foot of the wearer. The lower or bottom surface 308 of midsole 304 is provided with a cavity 310 generally sized and shaped to receive resilient insert 102. To form sole construction 302, the top and sides of resilient insert 102 are secured within cavity 310 by a bonding adhesive. The upper surface 312 of outsole 306 is then secured to the midsole and resilient insert by the same bonding adhesive.

As discussed in the Background, the shoe sole and resilient insert of the prior art tend to produce a "squeaking" sound as impact forces (such as those resulting from heel strike and toe-off) are applied to the shoe. These sounds are produced because the resilient insert and the foam of the midsole recover at different rates, as the heel and forefoot portions of the sole are relieved of impact forces. The varying rates of recovery of the midsole and resilient insert exert sheer stresses on the bond between the midsole and resilient insert (at the flashing and other areas) causing the two components to pull apart. As a space forms between the midsole and resilient insert, the components frictionally engage and move with respect to each other as the wearer applies a force to the sole. This friction can produce a squeaking noise within the interior of the shoe sole that is audible and undesirable to the wearer.

Squeaking can also be produced if the resilient insert does not fit properly within the cavity of the midsole. More particularly, the angles of the side walls are relatively flat (e.g., as at 208 in FIG. 2) and do not necessarily permit the side walls and top and bottom surfaces thereof to fit flush within the cavity. Because resilient insert 102 does not fit flush within cavity 310, the bond between the midsole and the resilient insert is weaker (or stronger) in different areas. The same holds true for the bond between resilient insert 102 and outsole 306, in that the angles of the resilient insert do not always permit proper bonding to the outsole. If the outsole is not properly bonded to the resilient insert, gaps or spaces form (such as those partially darkened at 314 in FIG. 3 for emphasis) which can produce a squeak when forces are applied to the sole. Inherent in the design of resilient insert 102 in FIGS. 1–3 are gaps which increase the probability that the shoe will squeak.

It should also be noted that the blow-molding technique discussed above with respect to resilient insert 102 of the prior art does not permit the formation of a fluid passageway of a particularly small diameter. As a result, a pinched or detailed impedance structure was required to restrict the flow of air between heel chamber 106 and forefoot chamber 108. Impedance structure 112 of the prior art, however, sometimes creates excessive turbulence within the interior of the passageway. This turbulence can be heard by the wearer, resulting in an undesired noise that mimics the sound of wheezing or breathing.

Figure 4:
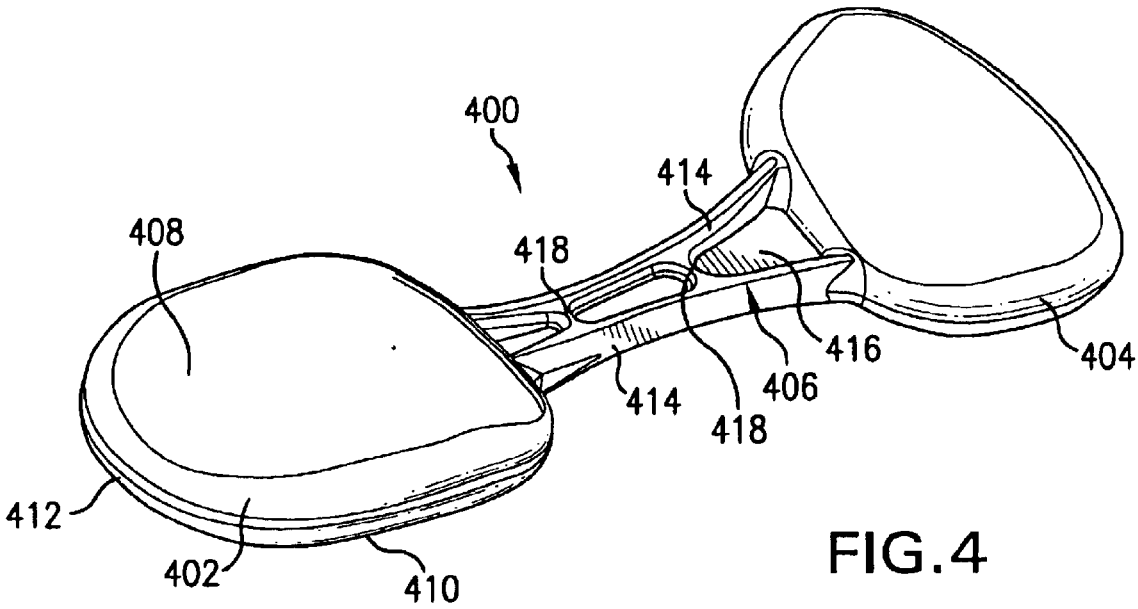
FIG. 4 is a right perspective view of the resilient insert of the present invention.

The shoe sole and resilient insert of the present invention reduces or remedies the squeaking and breathing noises of the prior art. Turning now to the present invention, FIG. 4 shows a top perspective view of resilient insert 400. Like resilient insert 102, resilient insert 400 comprises a top surface 408 and a bottom surface 410. Unlike resilient insert 102, resilient insert 400 makes intimate contact with all surfaces of the midsole cavity in which it is placed. A top surface 408, a bottom surface 410 and a side wall 412 define a heel chamber 402, a forefoot chamber 404, and a passageway 406. Top surface 408, bottom surface 410 and side wall 412 create a smooth surface for intimately contacting the midsole as will be described with reference to FIG. 10. Similar to the resilient insert of the prior art, passageway 406 fluidly connects heel chamber 402 to forefoot chamber 404 to permit air to flow back and forth between the chambers to provide continuous cushioning and support to the heel and forefoot of the wearer. It should be noted that top and bottom surfaces 408,410 of resilient insert 400 are slightly convex to create a "pre-loaded" condition which assists in pushing air within one chamber 402,404 to the other when a force is applied to the sole.

Unlike resilient insert 102, passageway 406 comprises two channels 414 separated by webbings 416 which are formed during the molding process to be discussed in more detail below. Also unlike the prior resilient insert, passageway 406 lacks an impedance structure disposed within the central portion of the passageway to overly restrict and create unnecessary turbulence within the flow of air as it passes from heel chamber 402 to forefoot chamber 404. Passageway 406 further comprises two, fluidly connected, cross-bars 418 which lend rigidity to the passageway of resilient insert 400 as it extends beneath the arch of the wearer's foot.

Figure 5:
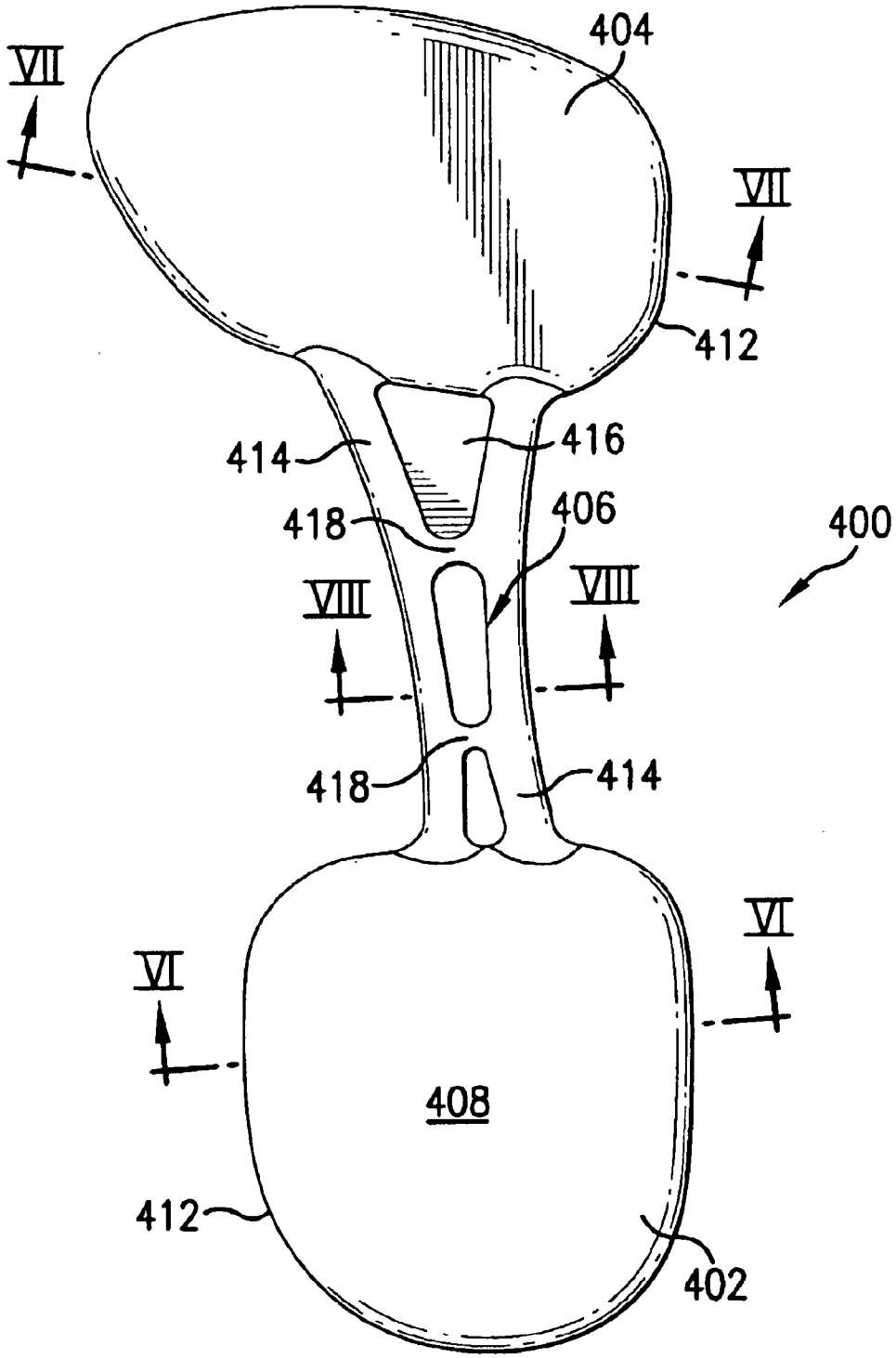
FIG. 5 is a top plan view of the resilient insert shown in FIG. 4.
Figure 6:
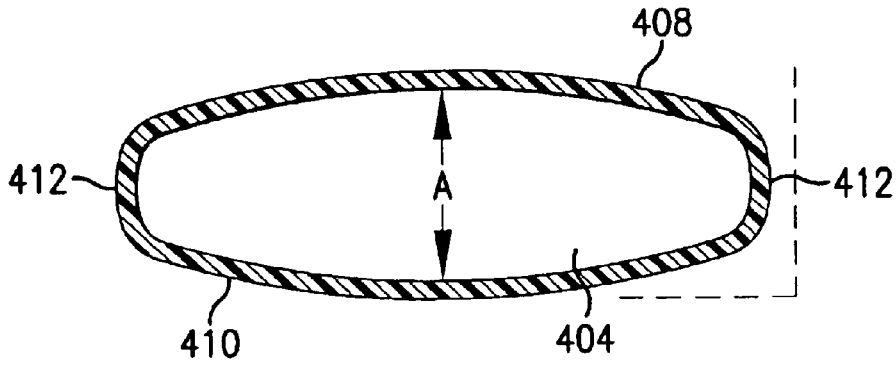
FIG. 6 is a cross-sectional view of the heel chamber of the resilient insert of the present invention taken along line VI—VI in FIG. 5.
Figure 7:
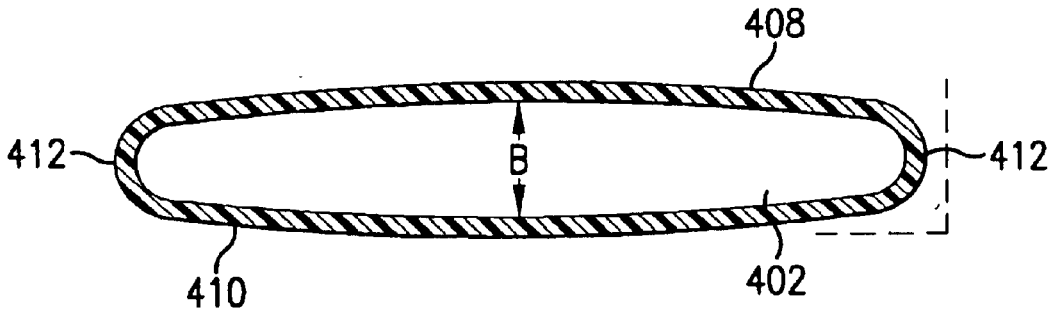
FIG. 7 is a cross-sectional view of the forefoot chamber of the resilient insert of present invention taken along line VII—VII in FIG. 5.
Figure 8:
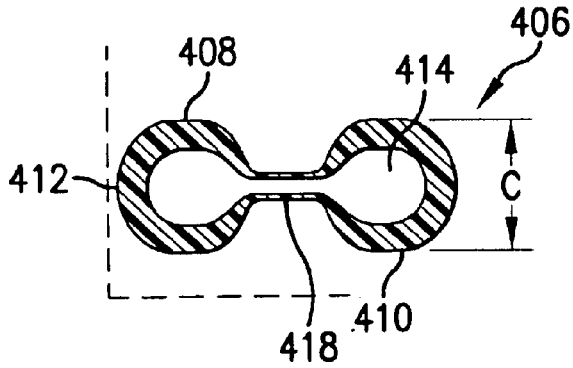
FIG. 8 is a cross-sectional view of the passageway of the resilient insert of the present invention taken along line VIII—VIII in FIG. 5.

FIG. 5 discloses a top plan view of resilient insert 400 of the present invention. As can be seen from the top plan view, side wall 412 of resilient insert 400 does not flare out from top or bottom surface 408,410 to form the "flat" angles 208 of the prior resilient insert which could inhibit a tight fit with the cavity of the midsole to be discussed in further detail below. Instead, and preferably, side wall 412 gently curves to meet top surface 408 and bottom surface 410 of resilient insert 400, so that the resilient insert fits intimately within a correspondingly contoured midsole cavity to be discussed below. FIGS. 6, 7 and 8 show cross-sectional views of resilient insert 400 taken through heel chamber 402, forefoot chamber 404 and passageway 406 in FIG. 5. FIG. 6 shows a cross-sectional view of heel chamber 402, FIG. 7 shows a cross-sectional view of forefoot chamber 404, and FIG. 8 shows a cross-sectional view of passageway 406 (with channels 414 and cross-bars 418). As can be seen from the cross-sectional views of FIGS. 6–8, the side wall of resilient insert 400 gently curves from to top and bottom surfaces 408,410 to avoid the flat angles associated with the prior art. The gentle curvature of side wall 412 allows resilient insert 400 to fit snugly within a correspondingly contoured, but slightly smaller, cavity of the midsole to be discussed below to reduce or eliminate spaces or gaps which could potentially trap air and produce a squeaking noise when a force is applied to the sole.

As shown in FIGS. 6–8, heel chamber 402 of resilient insert preferably has a height A of approximately 22.0 mm for a men's shoe size 9, forefoot chamber preferably has a height B of approximately 14.0 mm, and passageway 406 preferably has a height C of approximately 5.0 mm for a men's shoe size 9. While the height measurements disclosed herein represent a preferred embodiment of the resilient insert of the present invention, it should be realized that the heights may be altered to accommodate different sized shoes or users who are particularly heavy (or light), or those requiring other shoe enhancements which could interfere with the structure and function of the resilient insert. It should also be noted that in some applications, it may be desirable to have an insert which extends further into the forefoot of the shoe than the embodiment described herein. Obviously, the side wall of the resilient insert may be modified without departing from the spirit and scope of invention.

Since the invention of prior resilient insert 102, extrusion blow-molding techniques and materials therefor have further developed. Like the prior art, resilient insert 400 is formed by extrusion blow-molding. However, instead of extruding the elastomer into a mold and then blowing air into the mold to form the resilient insert, air (at ambient pressure) is blown into an elastomer through a tube to create a shapeless form. A mold is then brought about the form, and pressure is applied thereto, to mold the form into the desired shape of resilient insert 400. When the resilient insert has reached the desired shape, the tube is removed, the tube hole is pinched off, and the mold is removed. With the blow-molding technique of the present invention, resilient insert 400 (with air at ambient pressure sealed inside) can be formed without flashing 118 or other excess material which can interfere with the positioning, bonding or recovery of resilient insert 400.

This particular bonding technique also advantageously permits the formation of fluid passageways with relatively small diameters (generally ranging between 0.5 and 5.0 mm)

which function to keep air from rushing out of either heel chamber 402 or forefoot chamber 404 as a force is applied thereto, but do not unduly restrict or create turbulence within passageway 406, channels 414, and cross-bars 418 which could produce the wheezing or breathing sound discussed above.

In a preferred embodiment of the invention, and for reasons previously discussed, resilient insert 400 is formed from a material which has a rate of recovery similar, if not identical, to the rate of recovery of the sole (particularly, the midsole discussed below) of the shoe. Resilient insert 400 is preferably blow-molded from an ethylene vinyl acetate (EVA), specifically ATEVA®, available from AT Plastics. In this material, the percentage of ethylene (the elastomeric component of ethylene vinyl acetate) ranges from 16% to 21% and has a preferable percentage of 18%. In addition, the hardness of the material used to form midsole 900 is preferably on the Shore A scale, ranging from 85 to 95. While EVA is the preferred material for resilient insert 400, it should be understood by those skilled in the art that other materials can be selected, so long as such materials have the physical properties enumerated above and allow resilient insert to recover at the same rate as the midsole of the shoe (or at least do not interfere with that rate of recovery).

Figure 9:
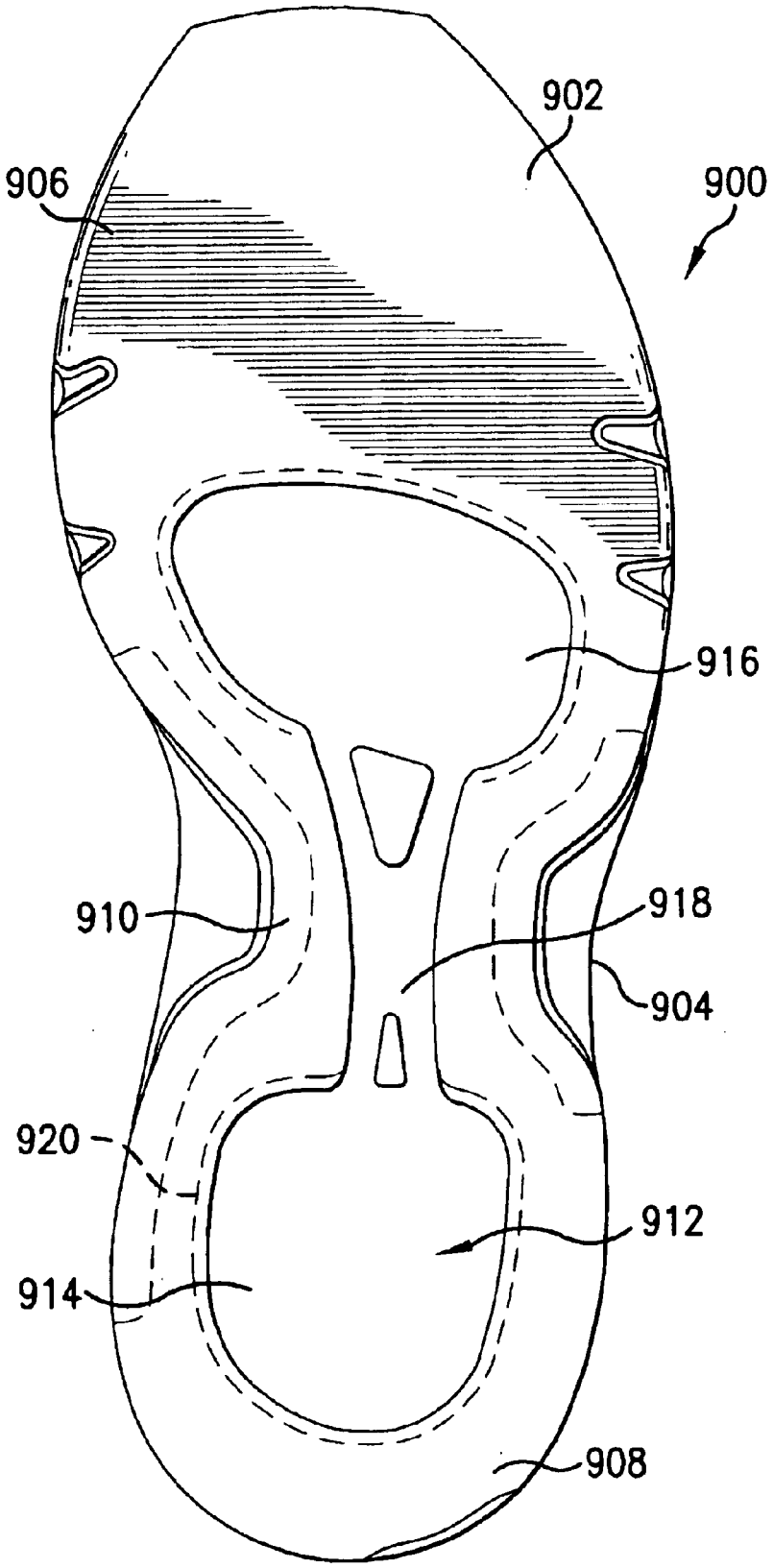
FIG. 9 is a bottom plan view of the midsole of the shoe sole of the present invention which receives the resilient insert of FIG. 1.
Figure 10:
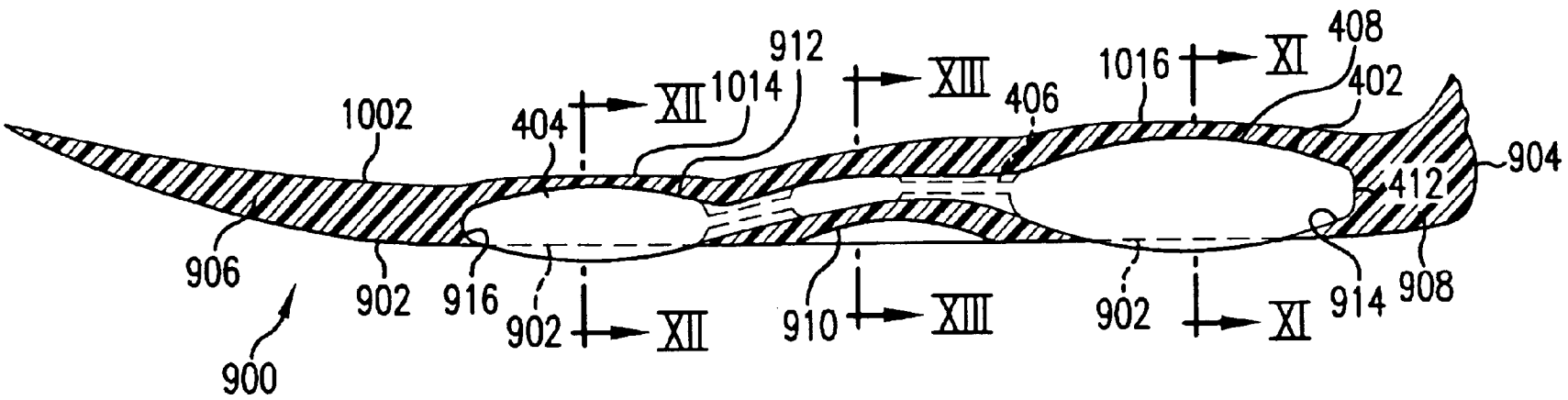
FIG. 10 is a cross-sectional view taken lengthwise through the midsole and resilient insert of the present invention.

FIG. 9 illustrates a bottom plan view of a midsole 900 of the present invention. Midsole 900 has a peripheral edge similar to the outline of the human foot. Midsole 900 comprises a bottom surface 902, a side wall 904, a forefoot portion 906, a heel portion 908, and an arch portion 910. As shown in FIG. 10, together, bottom surface 902, side wall 904 and top surface 1002 define midsole 900 preferably having a thickness which ranges from approximately 30.0 mm in height at heel portion 908 to approximately 1.0 mm at the extreme end of forefoot portion 906.

A cavity 912 is disposed within bottom surface 902 of midsole 900. Cavity 912 comprises a heel chamber recess 914, a forefoot chamber recess 916, and a passageway recess 918. The side walls of recesses 914,916,918 correspond in contour to the side wall of resilient insert 400, to ensure that no gaps occur between the resilient insert and cavity which could produce undesirable noises (as shown at dashed line 920 in FIG. 9).

As can be clearly seen from FIG. 9, the outline of cavity 912 is shaped essentially identical to the outline of resilient insert 400. However, the cavity is generally sized just slightly smaller than resilient insert 400. Cavity 912 is shaped and sized in this manner so that resilient insert 400 can be "pre-loaded" into the cavity of the midsole to facilitate the cushioning objectives of the present invention discussed in more detail below, and to ensure that the resilient insert fits within the cavity in a tight-fitting manner to avoid gaps and spaces which can produce undesirable noises in the shoe sole when a force is applied thereto.

FIG. 10 illustrates a cross-sectional view of midsole 900 with resilient insert 400 disposed therein. As can be seen from this figure, top and side walls 408,412 of heel chamber 402, forefoot chamber 404 and passageway 406 fit snugly within cavity 912. Chambers 402,404 and passageway 406 achieve a tight fit within cavity 912 due to the contour of the walls and the slightly smaller size of the cavity. In addition, the absence of flashing about the perimeter of resilient insert 400, and the avoidance of flat angles about the sides and top of the resilient insert permit it to be received snugly within the cavity of midsole 900.

It can also be seen from FIG. 10 that cavity 912, as it extends from heel recess cavity 914 to forefoot recess cavity 916, is not deep or wide enough to accommodate the entire volume of heel chamber 402 or forefoot chamber 404. The shallowness and slightly smaller size of cavity 912 is intentional, in that it permits the resilient insert to be "pre-loaded" in the shoe. More particularly, because heel and forefoot chambers 402,404 of resilient insert 400 bulge and extend convexly beyond the opening of cavity 912, chambers 402,404 receive impact forces before the shoe makes full contact with the ground (or the wearer's heel strikes the heel of the midsole). As a result, the air transfer process between heel and forefoot chambers 402,404 of resilient insert 400 is initiated or advanced before a force is fully applied to the shoe sole to ensure that a sufficient amount of fluidic cushioning and support is provided to the foot of the wearer at all stages of the gait cycle.

Figure 11:
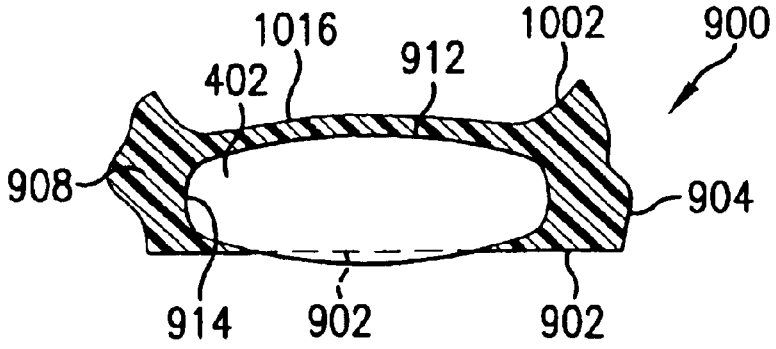
FIG. 11 is a cross-sectional view taken along line XI—XI in FIG. 10.
Figure 12:
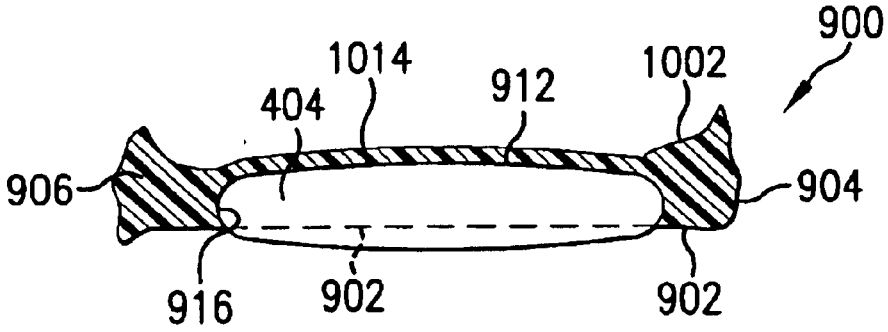
FIG. 12 is a cross-sectional view taken along line XII—XII in FIG. 10.
Figure 13:
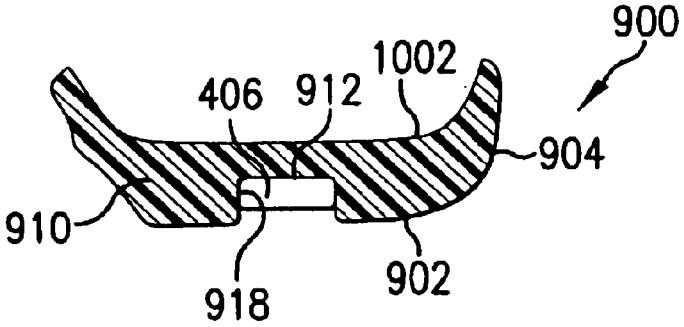
FIG. 13 is a cross-sectional view taken along line XIII—XIII in FIG. 10.

FIG. 11 illustrates a cross-sectional view of midsole 900 and resilient insert 400 of the present invention taken along line XI—XI of FIG. 10. As illustrated in this figure, heel chamber 402 fits snugly within heel recess cavity 914, but preferably extends convexly beyond bottom surface 902 of midsole 900 by approximately 2.5 mm. FIG. 12 illustrates a cross-sectional view taken along line XII—XII of FIG. 10. Like FIG. 11, FIG. 12 reveals that forefoot chamber 404 fits snugly within forefoot recess cavity 916, but preferably extends convexly beyond bottom surface 902 of midsole 900 by approximately 2.5 mm. As shown in FIG. 13, the top and side wall of passageway 406 fit snugly within passageway recess cavity 918. Taken together, FIGS. 11–13 clearly illustrate that cavity 912 of midsole 900 not only receives the resilient insert of the invention in a tight-fitting manner to avoid gaps and spaces which could result in the production of sound, but the tight-fit also permits the resilient insert to be pre-loaded into the shoe to facilitate the air transferring function of the chambers of the resilient insert.

In a preferred embodiment of resilient insert 400, heel recess cavity 914 preferably accommodates only 85–90% of heel chamber 402, and forefoot recess cavity 916 accommodates only 80–90% of forefoot chamber 404 of resilient insert 400. It should be apparent to those skilled in the art that recess cavities 914,916 can be modified to accommodate a resilient insert of any volume without departing from the scope of the invention, so long as portions of the heel and forefoot chambers extend preferably convexly beyond the heel and forefoot recess cavities within the noted ranges to achieve the pre-loaded state described above.

While the structure of midsole 900 is imperative to achieving the objectives of the present invention, so is the material from which midsole 900 is formed. As discussed above, the material used to form midsole 900 should have a flexibility and rate of recovery compatible with resilient insert 400, to avoid undue stress on the midsole and resilient insert, which could pull the midsole 900 and resilient insert 400 apart as impact forces are applied to and relieved of the shoe. Midsole 900 can be molded from any conventional midsole material (e.g., ethylene vinyl acetate or poly urethane) preferably having an Asker C hardness ranging between 45 and 60. Midsole 900 is injection molded using known injection molding techniques. While other materials can be used to form midsole 900, such materials should be compatible with the material used to mold resilient insert 400 to accomplish the stated objectives of the present invention.

Figure 14:
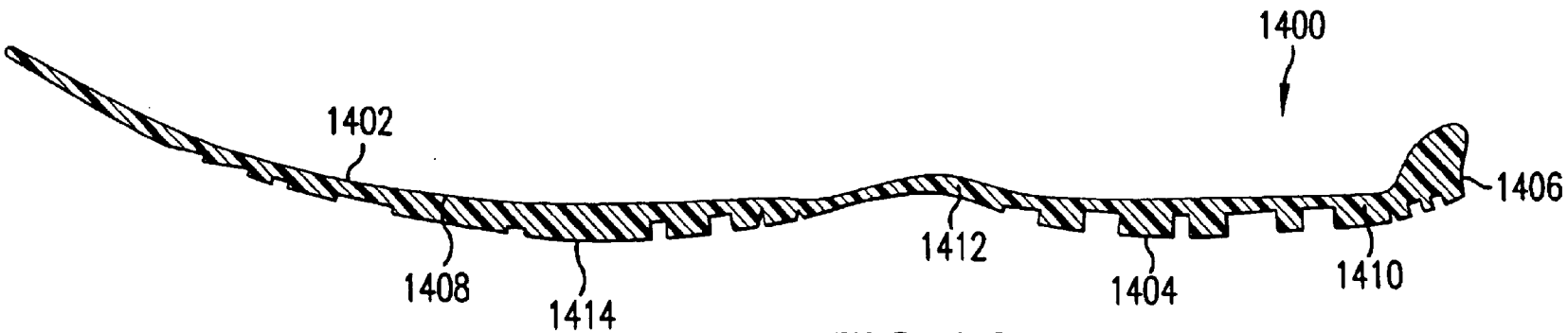
FIG. 14 is a cross-sectional view of the outsole of the present invention.
Figure 15:
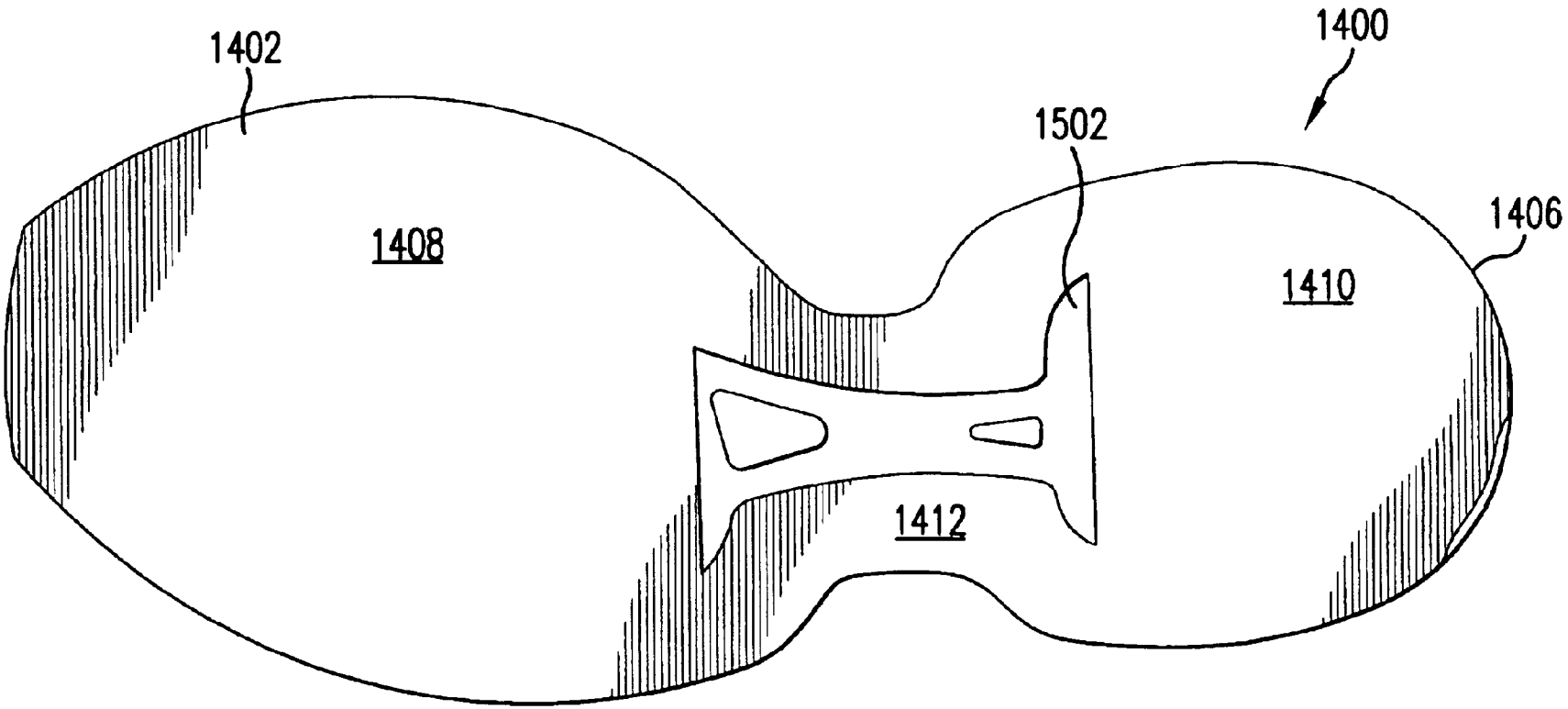
FIG. 15 is a top plan view of the outsole of FIG. 14.

To complete formation of the shoe sole of the preferred embodiment of the present invention, an outsole 1400 is secured to the bottom of midsole 900. FIGS. 14 and 15 illustrate outsole 1400 of the present invention. Like midsole 900, outsole 1400 comprises a peripheral edge similar to the outline of the human foot. Outsole 1400 comprises a top surface 1402, a bottom surface 1404, a side wall 1406, a forefoot portion 1408, a heel portion 1410 and an arch portion 1412. Bottom surface 1404 can be provided with a tread 1414 to provide increased traction. The majority of outsole 1400 is preferably formed from rubber or any other wear- and abrasive-resistant material.

FIG. 15 illustrates a top plan view of outsole 1400. As shown in this figure, arch portion 1412 of outsole 1400 is provided with a recession 1502 which is sized, shaped, and positioned to correspond to channels 414, webbing 416 and cross-bars 418 of passageway 406. Recession 1502 is provided so that passageway 406 and its related structure can be bonded tightly with outsole 1400 to avoid any gaps or spaces which could trap air and produce the unwanted squeaks and noises discussed above. The recession also prevents channels 414 and cross-bars 418 of passageway 406 from being pinched-off during the outsole bonding process, which could prevent or restrict air from flowing back and forth between heel chamber 402 and forefoot chamber 404.

Figure 16:
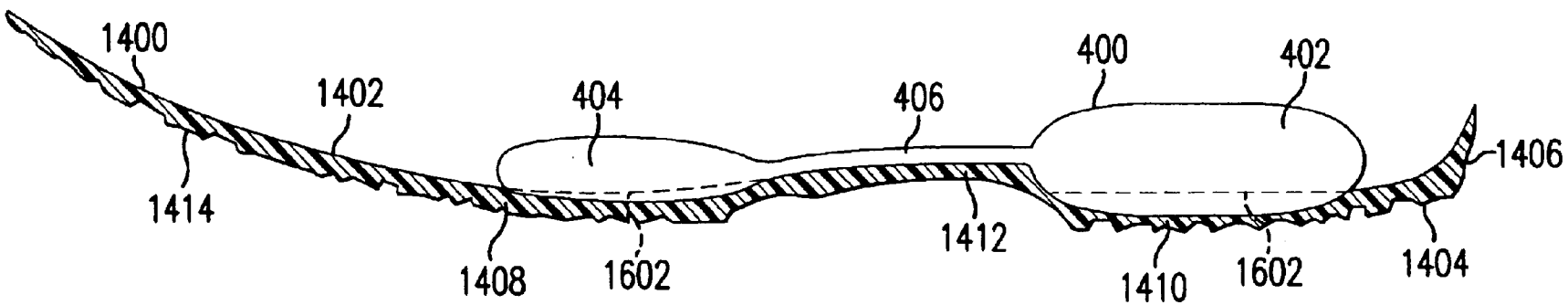
FIG. 16 is a cross-sectional view of the outsole of FIG. 14 with the resilient insert of the present invention disposed on the top surface of the outsole without the midsole of the present invention.

FIG. 16 shows resilient insert 400 disposed on top surface 1402 of outsole 1400. FIG. 16 is for illustrative purposes only, as midsole 900 is not shown. As can be seen in FIG. 16, when outsole 1400 is secured to the resilient insert, chambers 402,404 of resilient insert 400 cause outsole 1400 to bulge outwardly only slightly to accommodate the pre-loaded nature of chambers 402, 404 which extend convexly from bottom surface 902 of midsole 900. This outward bulging can be distinguished at dotted lines 1602 in FIG. 16. As outsole 1400 is secured by adhesive bonding to resilient insert 400, the pressure thereof causes top surface 1002 of midsole 900 to bulge upwardly at 1014 above forefoot chamber 406, and at 1016 above forefoot chamber 404, as shown in FIGS. 10, 11 and 12. Because the pre-loaded resilient insert forces top surface 1002 of midsole 900 to bulge up into direct contact with the foot at 1014,1016, the transfer of air between the chambers of the resilient insert is facilitated as soon as the wearer starts to initiate heel strike and subsequently proceeds to toe-off. Thus, pre-loaded resilient insert 400 can accept and absorb impact forces from either midsole 900 (via contact with wearer's foot) or outsole 1400 (via contact with the ground) to provide a continuous and appropriate amount of cushioning and support to the foot of the wearer. The bulges formed on the top surface of the midsole provide support and a better feel to the wearer's foot.

Figure 17:
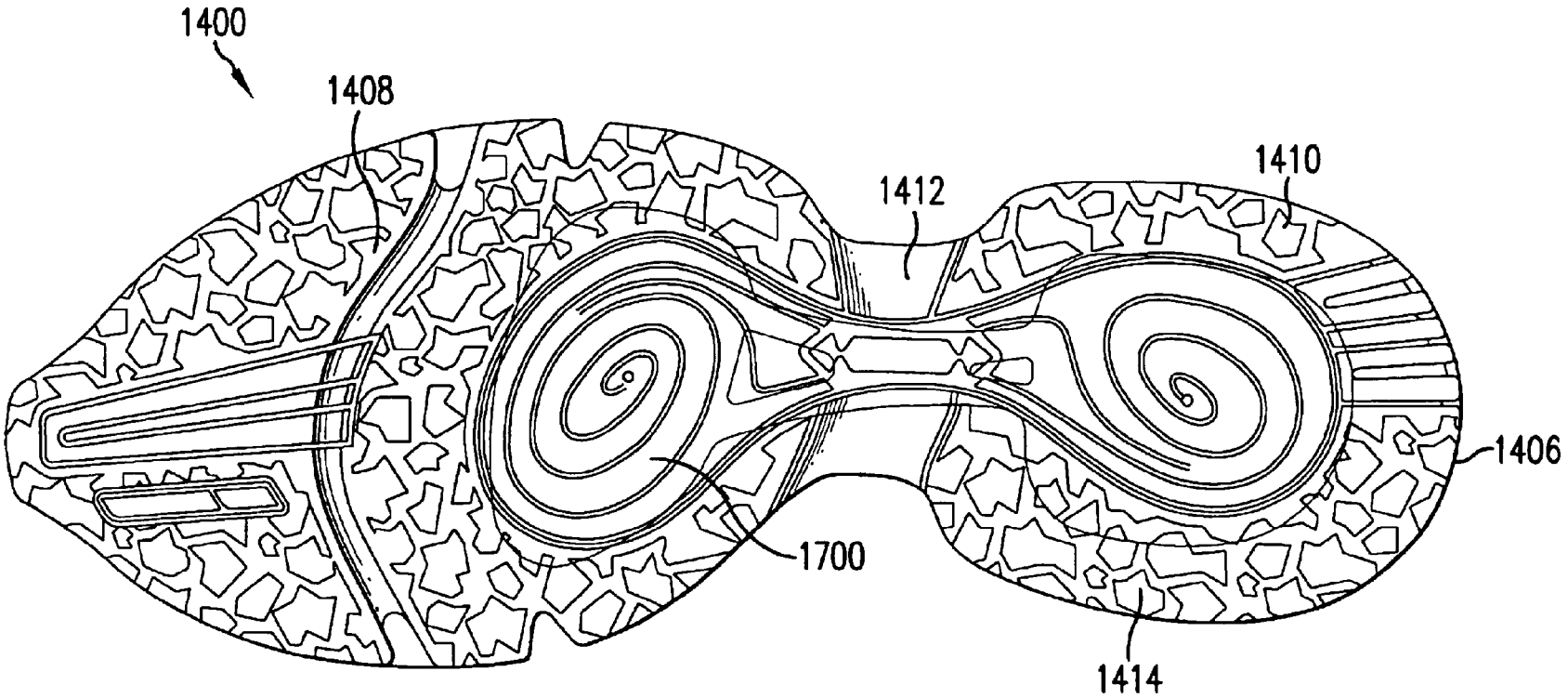
FIG. 17 is a bottom plan view of the outsole of FIG. 14.

FIG. 17 illustrates a bottom plan view of a preferred embodiment of outsole 1400 of the present invention. In this embodiment, outsole 1400 is provided with a translucent window 1700 which generally conforms to the outline of resilient insert 400. Translucent window 1700 permits the user and others to visualize the structure of resilient insert 400, including heel chamber 402, forefoot chamber 404 and passageway 406.

Figure 18:
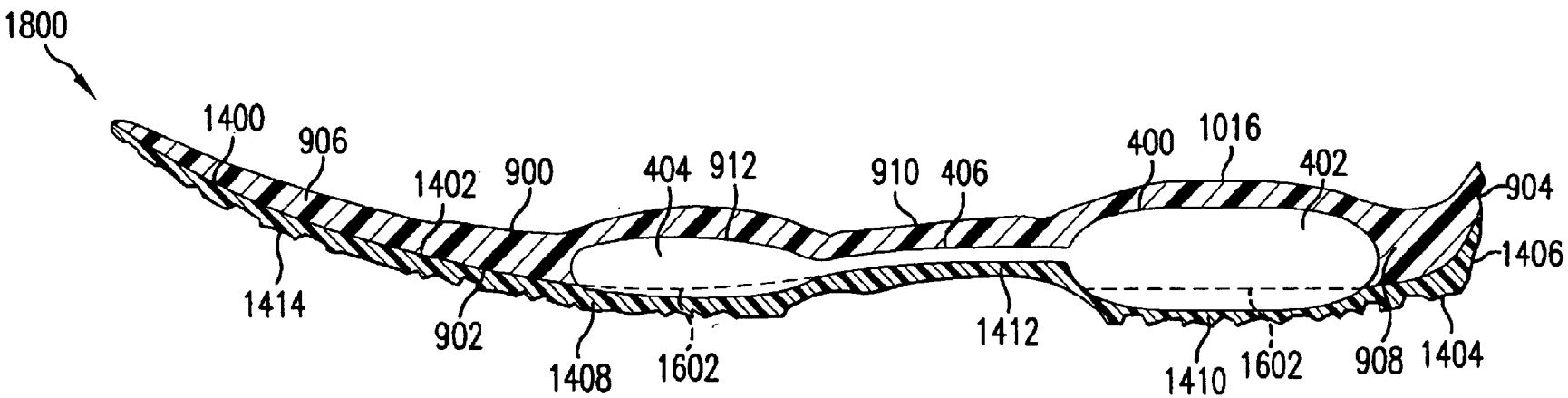
FIG. 18 is a cross-sectional view of the fully constructed shoe sole.

As shown in FIG. 18, when fully constructed, the shoe sole 1800 of the present invention comprises midsole 900, outsole 1400, resilient insert 400 disposed within cavity 914,916 of midsole 900 and above outsole 1400, to provide continuously fluidic cushioning and support to the foot of the wearer. Because resilient insert 400 and midsole 900 are molded from materials which permit compatible recovery, the application and release of impact forces on the shoe sole do not exert excessive stress on midsole 900 or resilient insert 400 which could cause the adhesive bond therebetween to break, resulting in friction and the production of undesirable squeaks and noises. The absence of flashing, and the substantially perpendicular side walls of the resilient insert (attributable to the modified extrusion blow-molding technique discussed above) further assure that no gaps or spaces are formed between resilient insert 400 and cavity 914,916 of midsole 900, or outsole 1400.

Finally, it should be noted that the modified extrusion blow-molding technique of the present invention permits the formation of fluid passageways having a relatively smaller diameter, which reduces the need for complex impedance structure which can cause excessive turbulence and the undesirable sound of wheezing or breathing as air flows through the resilient insert.

While the invention has been particularly shown and described with reference to the preferred embodiment of the invention, it should be understood by those skilled in the art that various changes in the form and details may be made herein without departing from the scope and spirit of the invention. For example, outsole 1400 could be provided with a cavity for receiving the resilient insert of the present invention instead of midsole 900 of the invention. Also, although midsole 900 and outsole 1400 have been described as separate components, resilient insert 400 could be disposed within a unitary sole component, and employed in a shoe with or without an insole or footbed. In addition, although the described resilient insert contains ambient air when it is initially manufactured (and perhaps a slightly higher pressure after construction of the shoe sole), it is contemplated that the resilient insert could contain fluid other than air (e.g., a liquid, high molecular weight gas, or gel). Moreover, the resilient insert may be pressurized either at the factory or by a user.

Furthermore, although the insert and the midsole are described as having recovery rates which are substantially the same, it is possible to achieve a shoe which minimizes squeaking by ensuring that there is an intimate bond between the resilient insert and the midsole. Thus, even if the insert and midsole inherently recover at different rates, the intimate bond will allow for maximum contact between the insert and the midsole and will avoid gaps to reduce squeaking. Therefore, one aspect of the invention is to provide maximum contact between the resilient insert and midsole to eliminate any gaps.

Finally, it should be realized that the features and advantages of the present invention are not limited to a shoe sole having a pneumatic resilient insert, midsole and outsole. Indeed, the specific molding methods and constructions disclosed herein can be applied to any shoe sole having multiple, molded and bonded components.

What is claimed is:

1. A shoe sole, comprising:

a midsole formed from a first elastomeric material, said midsole having a top surface, a bottom surface, and a side wall which define a first thickness;

an outsole having a top surface, a bottom surface, and a side wall which define a second thickness; and a resilient insert formed from a second elastomeric material and disposed between said bottom surface of said midsole and said top surface of said outsole, said resilient insert comprising a heel chamber, a forefoot chamber, and a passageway fluidly connecting said heel chamber and said forefoot chamber;

wherein said-second elastomeric material enables said resilient insert to recover at a rate similar to the rate of recovery of said midsole, to permit said resilient insert and said midsole to absorb and recover from impact forces applied to the shoe sole at substantially equal rates.

2. The shoe sole of claim 1, wherein said thickness of said midsole defines a cavity within said bottom surface of said midsole, said cavity having a top surface and a peripheral wall which define a heel chamber recess, a forefoot chamber recess, and a passageway recess, wherein said heel chamber recess, said forefoot chamber recess, and said passageway recess receive said heel chamber, said forefoot chamber, and said passageway of said resilient insert, respectively.

3. The shoe sole of claim 2, wherein said resilient insert is disposed within said cavity such that said peripheral wall and said top surface of said heel chamber recess, said forefoot chamber recess and said passageway recess intimately engage with said heel chamber, said forefoot chamber and said passageway chamber, respectively, to prevent the formation of gaps between said cavity and resilient insert to reduce the production of friction and related noise.

4. The shoe sole of claim 1, wherein said midsole is injection molded from a foam having an Asker C hardness ranging between 45 and 60.

5. The shoe sole of claim 1, wherein said resilient insert contains air at ambient pressure.

6. The shoe sole of claim 1, wherein said resilient insert contains air at a pressure greater than ambient air.

7. The shoe sole of claim 1, wherein said passageway of said resilient insert comprises a first channel and a second channel spaced a distance from said first channel by at least one fluidly connected cross channel, and said passageway is constructed to reduce turbulence in the ambient air contained within the passageway of the resilient insert.

8. A shoe sole, comprising:

a midsole formed from a first elastomeric material, said midsole having a top surface, a bottom surface, and a side wall which define a first thickness;

an outsole having a top surface, a bottom surface, and a side wall which define a second thickness; and a resilient insert formed from a second elastomeric material and disposed between said bottom surface of said midsole and said top surface of said outsole, wherein said second elastomeric material enables said resilient insert to recover at a rate similar to the rate of recovery of said midsole, to permit said resilient insert and said midsole to absorb and recover from impact forces applied to the shoe sole at substantially equal rates.

9. A shoe sole, comprising:

a resilient insert comprising a top surface, a bottom surface, and a side wall which extends between said top surface and said bottom surface;

an outsole; and a midsole having a top surface, a bottom surface, and a side wall which define a thickness, said midsole further comprising a cavity defined within said bottom surface of said midsole, said cavity having a top surface and a peripheral wall;

wherein said cavity of said midsole receives said resilient insert such that said side wall of said resilient insert is arranged substantially flush against said peripheral wall of said cavity to prevent the formation of gaps between said cavity and said resilient insert to reduce the production of friction and related noise.

10. The shoe sole of claim 9, wherein said resilient insert comprises a heel chamber, a forefoot chamber, and a passageway which fluidly connects said heel chamber and said forefoot chamber to permit air contained within the resilient insert to flow therebetween.

11. The shoe sole of claim 10, wherein said passageway is constructed to reduce turbulence within the air contained in said passageway of said resilient insert.

12. The shoe sole of claim 9, wherein said resilient insert is molded from an elastomeric material which permits said resilient insert to recover at a rate similar to the rate of recovery of said midsole, to permit said resilient insert and said midsole to absorb and recover from impact forces applied to the shoe sole at substantially equal rates.

13. The shoe sole of claim 12, wherein said midsole and said resilient insert are molded from ethyl vinyl acetate.

14. A shoe sole, comprising:

a midsole having a top surface and a bottom surface, said bottom surface of said midsole defining a cavity;

an resilient insert disposed within said cavity;

wherein upon application of a force to said top surface of said midsole, said midsole and said resilient insert are compressed, and wherein upon recovery from the force, shear stress between said resilient insert and said midsole is insufficient to cause relative movement between said midsole and said resilient insert.

15. The shoe sole of claim 14, wherein said midsole and said resilient insert are attached by an adhesive.

16. The shoe sole of claim 14, wherein the shear force between said midsole and said resilient insert upon recovery from being compressed is substantially zero.

17. A shoe sole, comprising:

a resilient insert comprising a top surface, a bottom surface, and a side wall which extends between said top surface and said bottom surface, and a first volume;

an outsole; and a midsole having a top surface, a bottom surface, and a side wall which define a thickness, said midsole further comprising a cavity defined within said bottom surface of said midsole, said cavity having a top surface, a peripheral wall and a second volume;

wherein said first volume of said resilient insert is greater than said second volume of said cavity, such that said first volume of said resilient insert is not fully accommodated by said second volume of said cavity, and when said cavity of said midsole receives said resilient insert, said side wall of said resilient insert is arranged substantially flush against said peripheral wall of said cavity to prevent the formation of gaps between said cavity and said resilient insert to reduce the production of friction and related noise.

* * * * *